US008893936B2

(12) United States Patent
Kuroda

(10) Patent No.: US 8,893,936 B2
(45) Date of Patent: Nov. 25, 2014

(54) CLOTHES HANGER

(71) Applicant: Akitada Kuroda, Kuwana (JP)

(72) Inventor: Akitada Kuroda, Kuwana (JP)

( * ) Notice: Subject to any disclaimer, the term of this patent is extended or adjusted under 35 U.S.C. 154(b) by 0 days.

(21) Appl. No.: 13/789,626

(22) Filed: Mar. 7, 2013

(65) Prior Publication Data

US 2013/0306688 A1 Nov. 21, 2013

(30) Foreign Application Priority Data

| | | |
|---|---|---|
| Mar. 9, 2012 | (JP) | 2012-052490 |
| Aug. 11, 2012 | (JP) | 2012-179113 |
| Aug. 16, 2012 | (JP) | 2012-180690 |
| Oct. 7, 2012 | (JP) | 2012-223731 |

(51) Int. Cl.

| | |
|---|---|
| ***A47G 25/48*** | (2006.01) |
| ***A47G 25/32*** | (2006.01) |
| ***A47G 25/18*** | (2006.01) |
| *A41D 27/22* | (2006.01) |

(52) U.S. Cl.

CPC ..... *A47G 25/482* (2013.01); *A47G 25/32* (2013.01); *A47G 25/48* (2013.01); *A47G 25/186* (2013.01)

USPC ..... 223/91

(58) Field of Classification Search

CPC ..... A47G 25/06; A47G 25/14; A47G 25/24; A47G 25/28; A47G 25/48; A47G 25/481–25/487; A47G 25/50; D06F 55/02; A41F 11/02

USPC ..... 24/501, 516, 562, 563, 542, 545; 223/85, 90, 91, 93, 96

See application file for complete search history.

(56) References Cited

U.S. PATENT DOCUMENTS

| | | | | | |
|---|---|---|---|---|---|
| 773,583 | A | * | 11/1904 | Nagely | 223/95 |
| 1,421,709 | A | * | 7/1922 | Nelson | 211/119 |
| 1,478,290 | A | * | 12/1923 | Marks | 223/93 |
| 1,750,905 | A | * | 3/1930 | Schilpp | 223/91 |
| 1,991,987 | A | * | 2/1935 | Smith | 223/91 |
| 1,999,310 | A | * | 4/1935 | Thompson | D6/319 |
| 2,378,578 | A | * | 6/1945 | Oskow | 223/90 |
| 3,085,724 | A | * | 4/1963 | Wilde | 223/85 |
| 3,091,344 | A | * | 5/1963 | Bullock | 211/113 |
| D206,207 | S | * | 11/1966 | Stein | D6/319 |
| 3,471,069 | A | * | 10/1969 | Simon | 223/91 |
| 5,074,445 | A | * | 12/1991 | Chen | 223/85 |
| 5,294,005 | A | * | 3/1994 | Hedges | 211/85.7 |
| 5,806,727 | A | * | 9/1998 | Joseph | 223/85 |
| 2010/0025439 | A1 | * | 2/2010 | Diamond et al. | 223/88 |

* cited by examiner

*Primary Examiner* — Ismael Izaguirre

(57) ABSTRACT

[Object of the invention] Releasing all clips at once easily.
[Solution] A clothes hanger comprises a substantially horizontally arranged rod, a rigid hanger body which support the rod at the both ends thereof, a plural clip through which the rod is inserted, and a plural spacer through which the rod is inserted between the clips. Each clip has a pair of clip bodies, a hinge situated near the center of said clip bodies, a through hole formed above the hinge, an operation part situated above said through hole, a holding part at the lower end of the clip bodies and an elastic element which forces the holding part to the closed position.

3 Claims, 10 Drawing Sheets

CLOTHES HANGER

CROSS-REFERENCE TO RELATED APPLICATIONS

I claim the benefit of priority of Japanese patent application No.

2012-052490 (filed on 9 Mar. 2012),
2012-179113 (filed on 11 Aug. 2012),
2012-180690 (filed on 16 Aug. 2012),
2012-223731 (filed on 7 Oct. 2012).

TECHNICAL FIELD

This invention relates generally to a clothes hanger for hanging clothes or laundries with plural clips.

BACKGROUND ART

Heretofore, there are various types of clothes hanger with a square or a round frame and plural clips for hanging clothes or laundries. However, it is troublesome to release all the clothes, because it is necessary to open each clip one by one.

CITATION LIST

Patent Literature

[PTL 1] JP1995-255995

SUMMARY OF INVENTION

Technical Problem

A prior art disclosed by PTL1 relates to a clothes hanger of which all clips can be opened at once. However, the prior art has problems as follows. When each clip is tried to be opened with fingers, a strong force is necessary, because a part of the clip nearer to the fulcrum point thereof must be pressed as shown by Fl in FIG. 2. Besides, when opening the clips, fingers must be inserted under the hanger frame where is crowded with the clips and the clothes. Moreover, the prior art is complicated and heavy.

Solution to Problem

A clothes hanger comprising;

a substantially horizontally arranged rod;

a hanger body which supports said rod at the both ends thereof;

a plural clip through which said rod is inserted;

and a plural spacer through which said rod is inserted between said clips;

wherein said each clip has a pair of clip bodies, a hinge situated near the center of said clip bodies, a through hole formed above said hinge, an operation part situated above said through hole, a holding part at the lower end of said clip bodies;

and an elastic element which forces said holding part to the closed position.

The above clothes hanger, wherein said spacers have tube shape and said operation parts are longer than 5 mm.

The above clothes hanger, wherein said hanger body is comprised of a no. 1 hanger body and a no. 2 hanger body, a moving element between said no. 1 hanger body and no. 2 hanger body, a no. 1 clip pressing part and a no. 2 clip pressing part provided at each outer end of the no. 1 hanger body and the no. 2 hanger body, and a no. 1 pushing part and a no. 2 pushing part situated between said each clip pressing part and said moving element, wherein said rod is slidably inserted into said no. 1 clip pressing part and no. 2 clip pressing part.

The above clothes hanger, wherein said hanger body has a lateral projection near upper center thereof.

A method of hanging and releasing clothes or laundries, using a clothes hanger comprising;

a substantially horizontally arranged rod;

a rigid hanger body which support said rod at the both ends thereof;

a plural clip through which said rod is inserted;

and a plural spacer through which said rod is inserted between said clips;

wherein said each clip has a pair of clip bodies, a hinge situated near the center of said clip bodies, a through hole and an operation part formed above said hinge, a holding part at the lower end of said clip bodies; and an elastic element which forces said holding part to the closed position.

wherein said hanger body is comprised of a no. 1 hanger body and a no. 2 hanger body, a moving element between said no. 1 hanger body and no. 2 hanger body, a no. 1 clip pressing part and a no. 2 clip pressing part provided at each outer end of said no. 1 hanger body and no. 2 hanger body, and a no. 1 pushing part and a no. 2 pushing part situated between said each clip pressing part and said moving element, wherein said rod is slidably inserted into said no. 1 clip pressing part and no. 2 clip pressing part, when holding the clothes, said operation parts are pressed inwardly, when all clothes and laundries are released at once, said no. 1 pushing part and no. 2 pushing part are grasped by a hand.

Advantageous Effects of Invention

Based on above mentioned invention, it becomes possible to release all the clothes at once with smaller force, solving the above mentioned problems.

DESCRIPTION OF EMBODIMENTS

Figure 1:
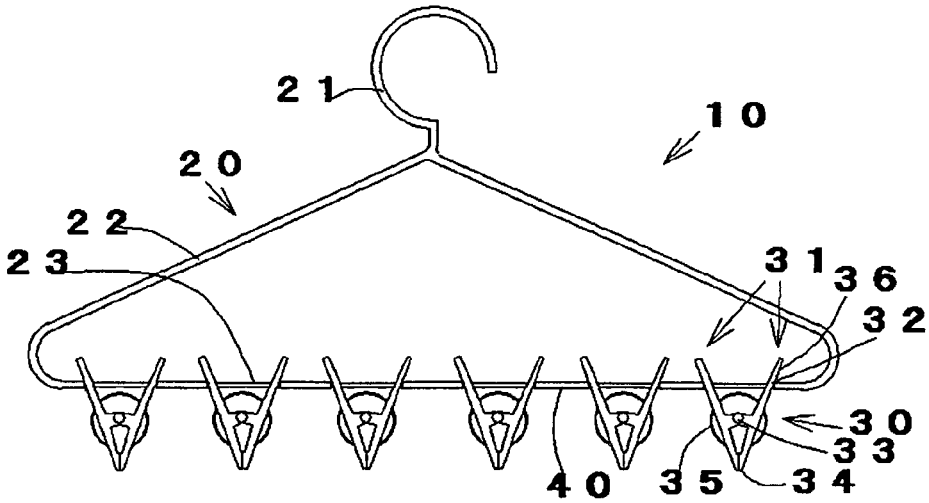
FIG. 1 is a front view of a first embodiment of the invention.
Figure 2:
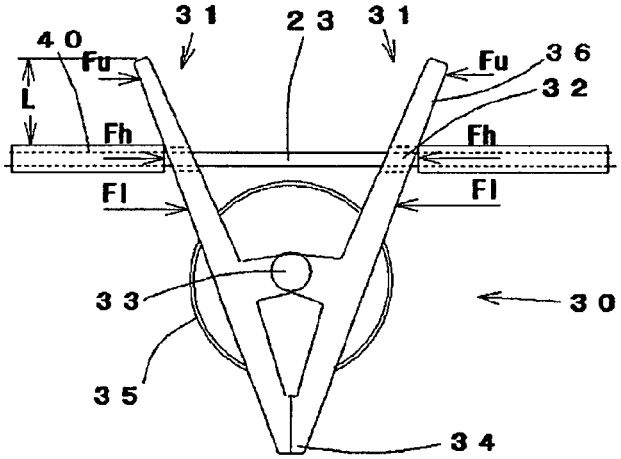
FIG. 2 is an enlarged front view of a clip of the invention.

Referring to FIG. 1 and FIG. 2 a first embodiment of the invention is shown. A clothes hanger 10 is comprised of a rod 23, a hanger body 20 supporting the rod 23, clips 30, and spacers 40. The hanger body 20 is comprised of a mountain like shape shoulder 22, and a hook 21. The both ends of the shoulder 22 are extended to the rod 23.

Figure 25:
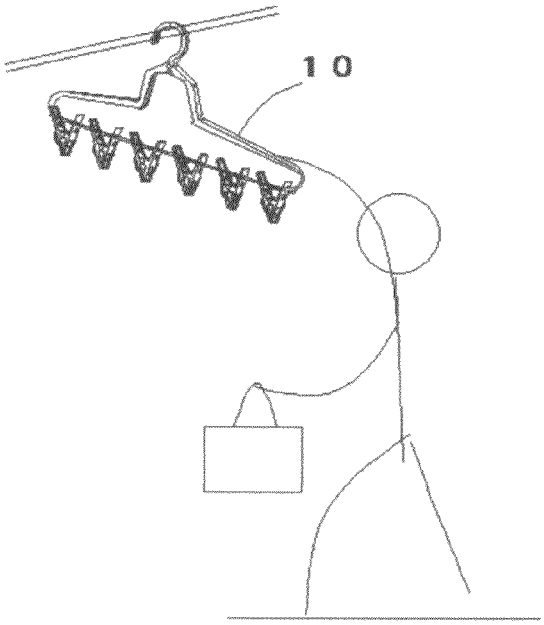
FIG. 25 is a front view of the first embodiment of the invention to place it at a higher position.

The hanger body 20 is made of rigid material such as plastics, metal, wood and like. Therefore, the shape of the hanger body 20 is kept, even though the hanger body is held at any point thereof. So, as shown by FIG. 25, it is possible to hook the clothes hanger 10 at a higher position by holding the lower part of the clothes hanger 10.

The clip 30 is comprised of two clip bodies 31 and an elastic element 35. The two clip bodies 31 are pivotally connected by a hinge 33 near the center thereof. The two clip bodies 31 are forced to close by the elastic element 35. Through holes 32 are formed above the hinge 33, and the operation parts 36 is formed extending above and upward from the through holes 32. The spacers 40 have a tube type shape having the through hole which is a little bit larger than the outer diameter of the rod 23. The diameter of the through holes 32 is smaller than the outer diameter of the spacer 40. The rod 23 is inserted into the through holes 32 of the clips 30 and the through holes of the spacer 40 alternately.

When holding the clothes, an operation part 36 of the clip 30 is pressed like Fu. As shown by FIG. 2, in the case of the prior art, the lower point below the rod 23 must be pressed like Fl of which the force must be much greater than Fu. Therefore, the clip 30 can be opened with smaller force by this invention.

The two clip bodies 31 may be unitarily formed by one material such as plastics. They may be formed by one piece of metal wire including the elastic element 35.

Figure 3:
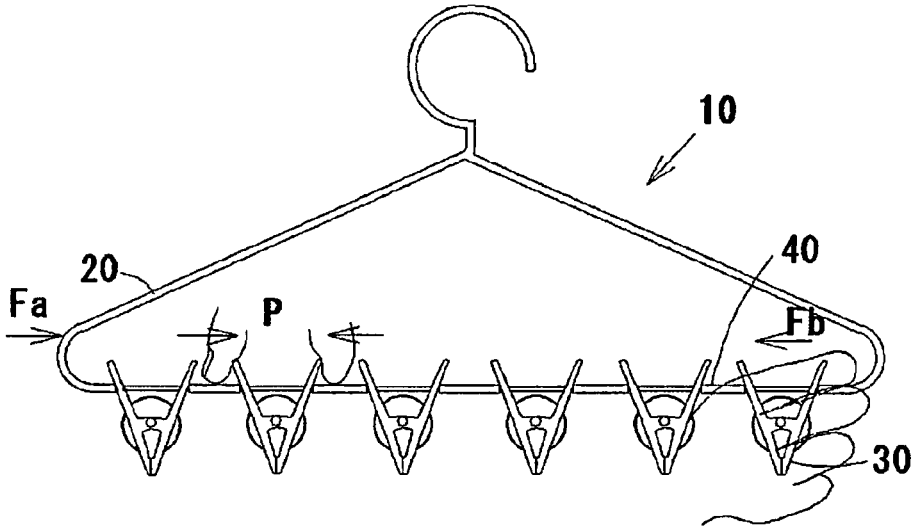
FIG. 3 is a front view of the first embodiment of the invention to show how to hold and release the clothes.
Figure 4:
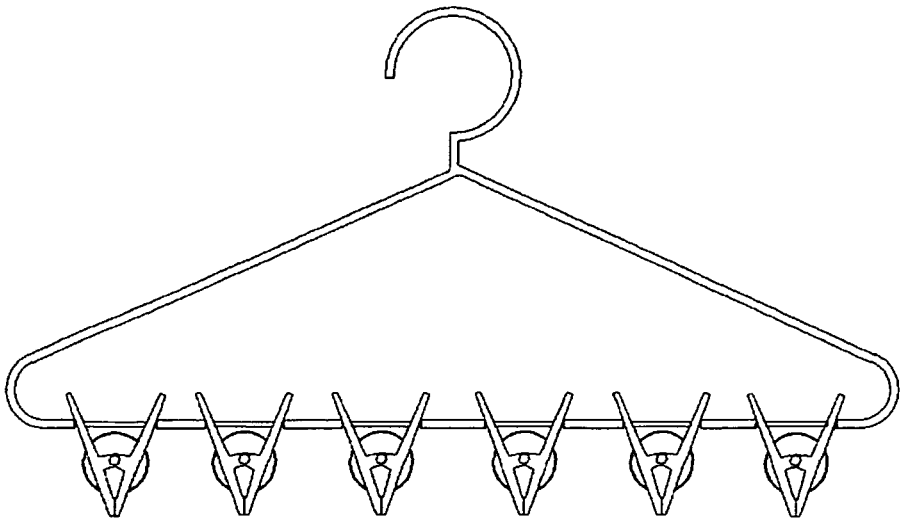
FIG. 4 is a rear view of the first embodiment of the invention.
Figure 5:
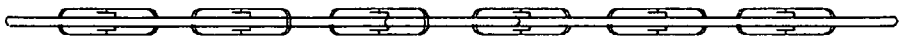
FIG. 5 is a plan view of the first embodiment of the invention.
Figure 6:
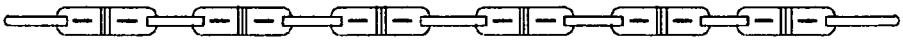
FIG. 6 is a bottom view of the first embodiment of the invention.
Figure 7:
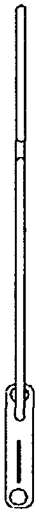
FIG. 7 is a left side view of the first embodiment of the invention.
Figure 8:
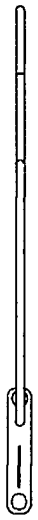
FIG. 8 is a right side view of the first embodiment of the invention.

Referring to FIG. 3, the method of holding the clothes and releasing is shown. When holding the clothes, the operation part 36 is pressed by fingers like P (=Fu). When releasing all the clothes at once, the outer most clip 30 is pressed like Fb, supporting the hanger body 20 like Fa.

Referring to Table 1 (the test data of the examples), the force Fu to open each clip is 663 g (49% of Fl) which is 51% smaller than the prior art force 1340 g (Fl).

TABLE 1

ピンチを開くときの操作力の測定結果

| | N1 | N2 | N3 | N4 | N5 | N6 | N7 | N8 | N9 | N10 | 平均 |
|---|---|---|---|---|---|---|---|---|---|---|---|
| Fu (実施例) g | 670 | 680 | 670 | 660 | 670 | 660 | 680 | 650 | 640 | 650 | 663 |
| Fl (従来技術) g | 1300 | 1500 | 1300 | 1200 | 1200 | 1500 | 1300 | 1400 | 1300 | 1400 | 1340 |
| Fu/Fl | | | | | | | | | | | 49% |
| Fh (参考) g | 880 | 850 | 860 | 860 | 850 | 860 | 840 | 880 | 840 | 840 | 856 |

Referring to Table 2 (the evaluation data of maneuverability, when opening each clips 30), the length L of the operation part 36 must be 5 mm at least and 10 mm or more preferably.

TABLE 2

ピンチを個々に開く場合の操作性の評価

| L mm | 2 | 3 | 4 | 5 | 6 | 7 | 8 | 9 | 10 | 11 | 12 |
|---|---|---|---|---|---|---|---|---|---|---|---|
| 評価 | x | x | x | ○ | ○ | ○ | ○ | ○ | ◎ | ◎ | ◎ |

| 評価指標 | | |
|---|---|---|
| | x | ピンチの操作不可能 |
| | ○ | 少しやり難いがピンチの操作可能 |
| | ◎ | ピンチの操作可能、やり易い |

Maneuverability x; difficult ○; possible ◎; easily possible
L mm; the length of the operation part as shown in FIG. 2

As shown by this embodiment 1, opening the clips 30 become easy, because the operation part 36 is accessible from the upper open space rather than under crowded space with clothes.

Referring to FIG. 3, we can understand that Fu<Fh<Fl, because of fulcrum principle. When opening the each clip 30 with two fingers, smaller force Fu is preferable. When releasing the all clothes at once, the opening force Fh may be bigger than Fu, because more than two fingers are used to open the clips 30.

The clothes hanger 10 of this embodiment can be used as a normal clothes hanger, because the hanger body has a rigid mountain like shoulder 22.

Figure 9:
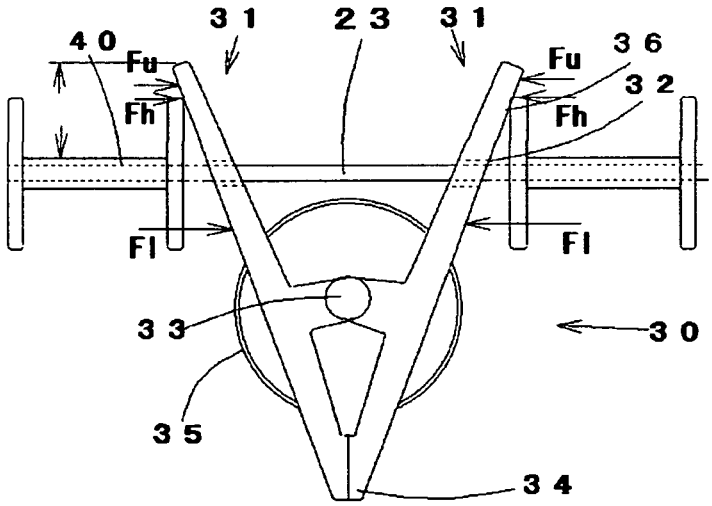
FIG. 9 is an enlarged view of a second embodiment of the invention.
Figure 10:
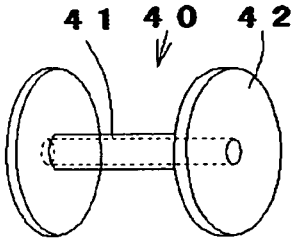
FIG. 10 is a perspective view of a spacer of the second embodiment of the invention.

Referring to FIG. 9 and FIG. 10, the second embodiment is shown. The spacer 40 has a tube 41 and two flanges 42.

Figure 11:
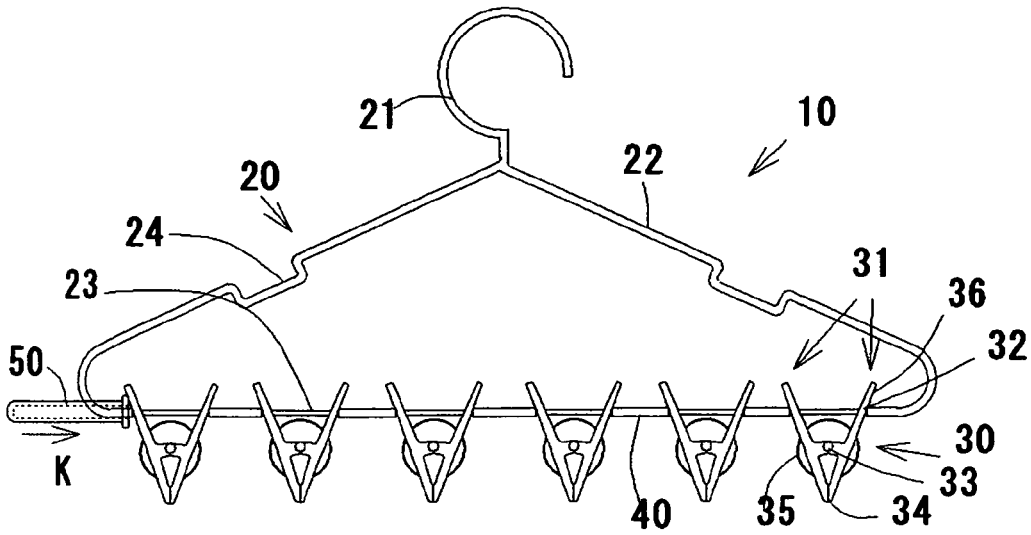
FIG. 11 is a front view of a third embodiment of the invention.

Referring to FIG. 11, the third embodiment is shown. The clothes hanger 10 has a release assistant part 50.

Figure 12:
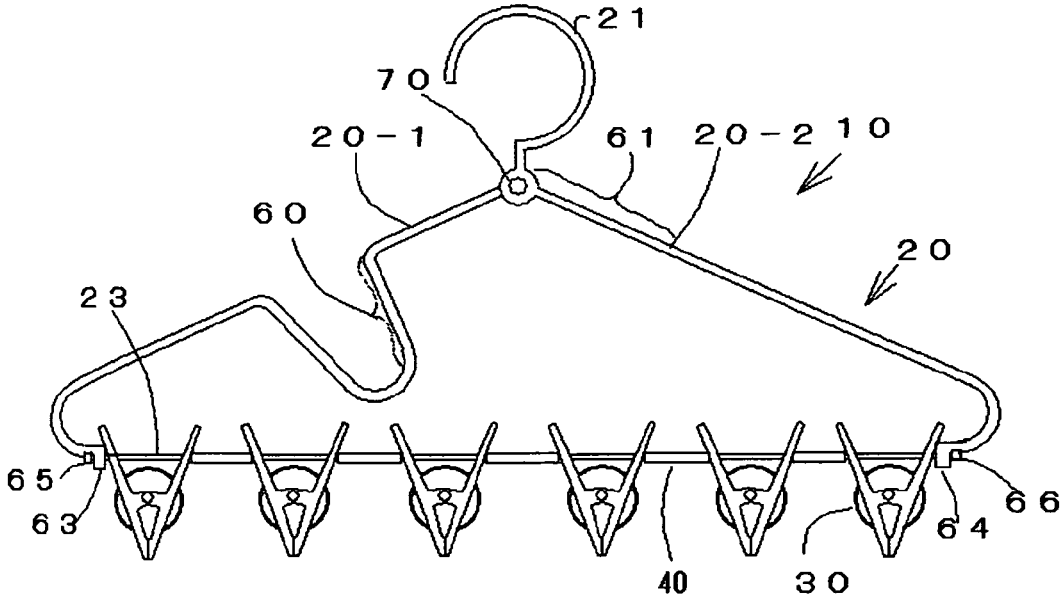
FIG. 12 is a front view of a fourth embodiment of the invention.

Referring to FIG. 12, the fourth embodiment is shown. The hanger body 20 has a no. 1 hanger body 20-1 and a no. 2 hanger body 20-2. The no. 1 hanger body 20-1 and the no. 2 hanger body 20-2 are pivotally connected by a moving element 70 such as a hinge at the center thereof. The no. 1 hanger body 20-1 and the no. 2 hanger body 20-2 also have a no. 1 clip pressing part 63 and a no. 2 clip pressing part 64 provided at each outer end of the no. 1 hanger body 20-1 and the no. 2 hanger body 20-2. The rod 23 is slidably inserted into each through hole of the no. 1 clip pressing part 63 and the no. 2 clip pressing part 64. Retainers 65, 66 are fixed at the both ends of the rod 23. If the retainers 65, 66 are removably connected to the rod 23, changing the clip 30 becomes easy.

The no. 1 hanger body 20-1 and the no. 2 hanger body 20-2 also have, a no. 1 pushing part 60 and a no. 2 pushing part 61 situated between the each clip pressing part and the moving element 70.

Figure 13:
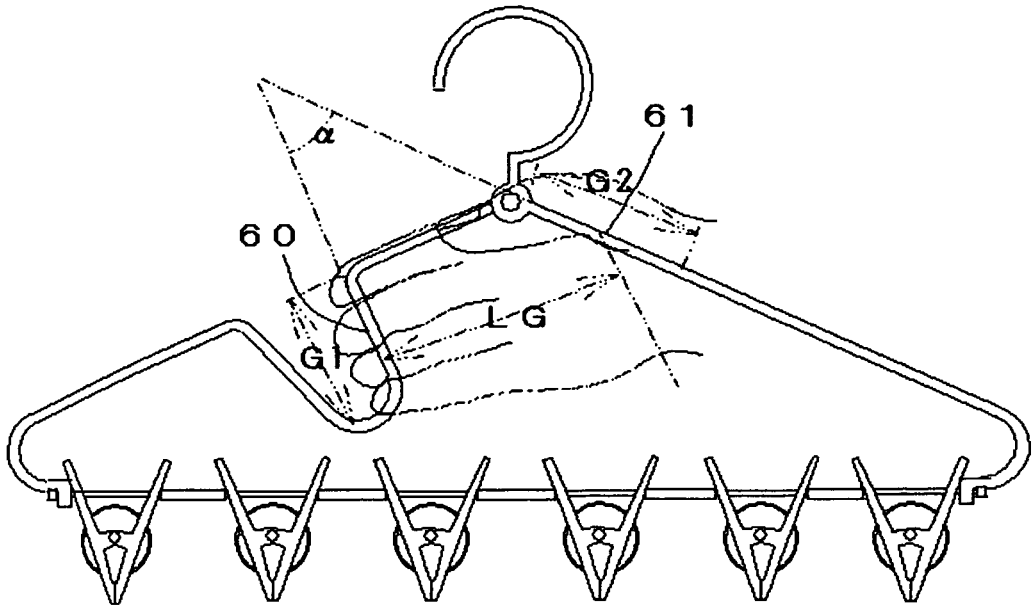
FIG. 13 is a front view of the fourth embodiment of the invention just before opening all the clips.

As shown by FIG. 13, when opening all the clips 30 at once, a hand is placed between the no. 1 pushing part 60 and the no. 2 pushing part 61 and grasp the no. 1 pushing part 60 and the no. 2 pushing part 61. Then all the clips are opened like FIG. 14.

Figure 14:
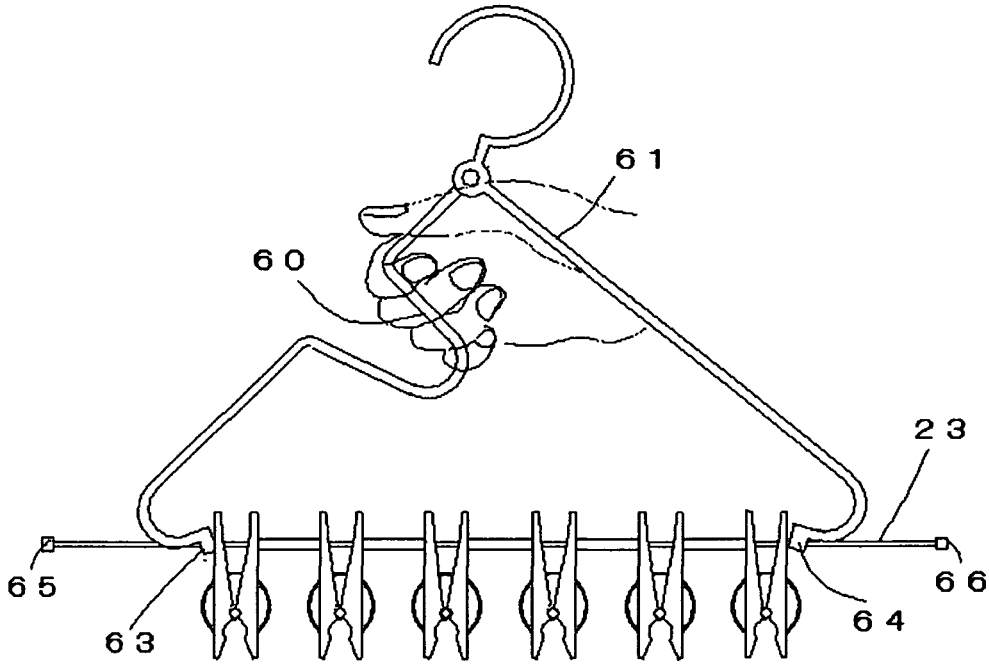
FIG. 14 is a front view of the fourth embodiment of the invention opening all the clips at once.

As shown by FIG. 14, after the no. 1 pushing part 60 and the no. 2 pushing part 61 are grasped, the no. 1 hanger body 20-1 and the no. 2 hanger body 20-2 turn inwardly and all the clips 30 are pressed and opened.

The smaller positive angle $\alpha$ between the no. 1 pushing part 60 and the no. 2 is preferable.

If $\alpha$ is small positive angle, after grasping, $\alpha$ becomes nearly 0 degree, which is easy to grasp.

In this case, the test result of grasping force is 1.8 Kg. According to the statistics, the grip force of average Japanese 6 years old girl is 8.55 Kg, the grip force of average Japanese 75 to 79 years old women is 21.9 Kg. Therefore, it is easy to handle this clothes hanger regardless of age or sex.

With this clothes hanger, we can release all the clothes, by grasping the no. 1 pushing part 60 and no. 2 pushing part 61, at the same time as putting away the clothes hanger on the laundry pole. This can be done by one hand, this is convenient not only for persons with normal body but also for physically handicapped persons.

Figure 15:
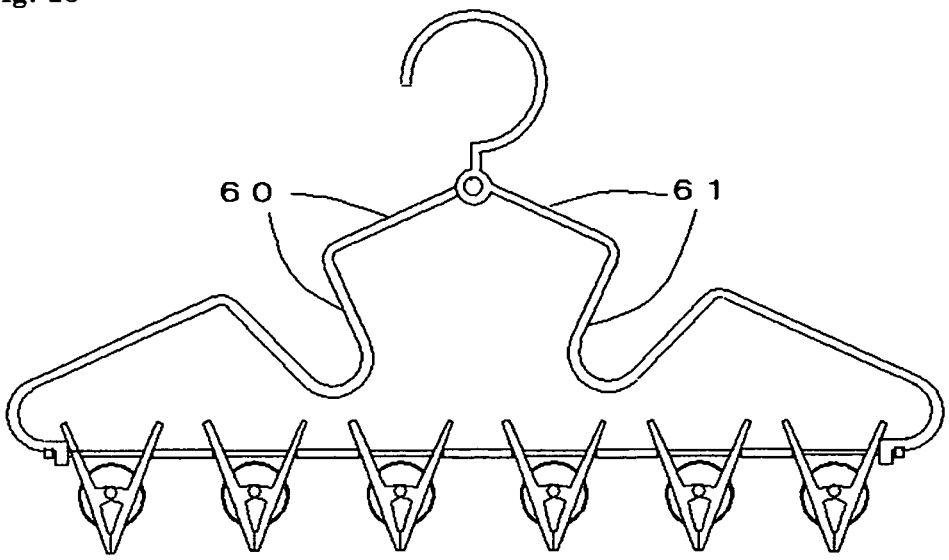
FIG. 15 is a front view of the fifth embodiment of the invention.

FIG. 15 shows the embodiment of the clothes hanger 10 which can be operated from the both sides of it.

Figure 16:
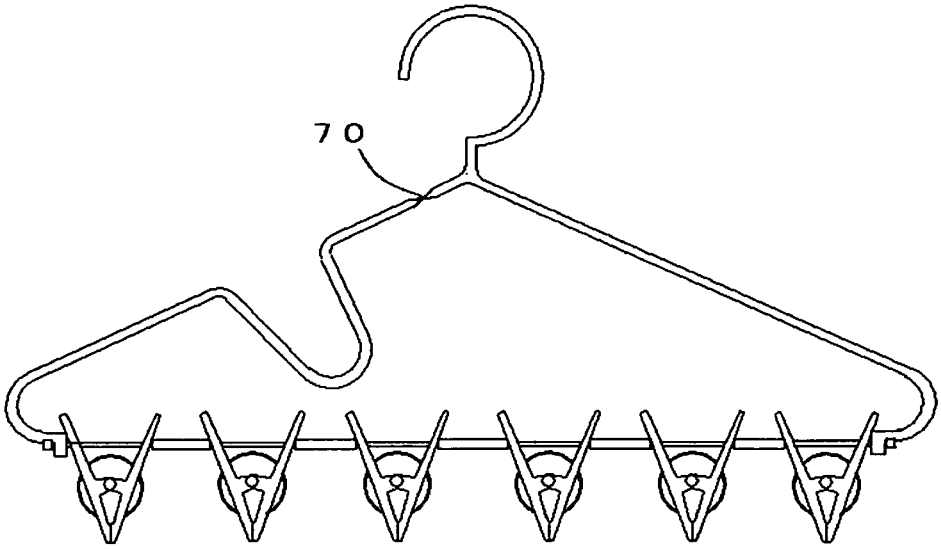
FIG. 16 is a front view of the sixth embodiment of the invention.

FIG. 16 shows the embodiment of the clothes hanger 10 which has thin plastic flexible hinge as the moving element 70.

Figure 17:
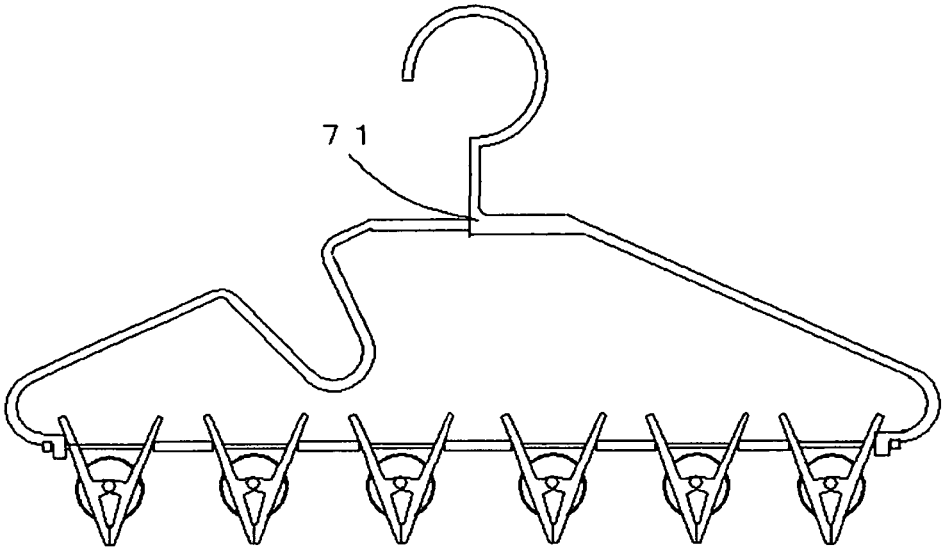
FIG. 17 is a front view of a seventh embodiment of the invention.

FIG. 17 shows the embodiment of the clothes hanger 10 which has a slider 71 as the moving element 70.

Figure 18:
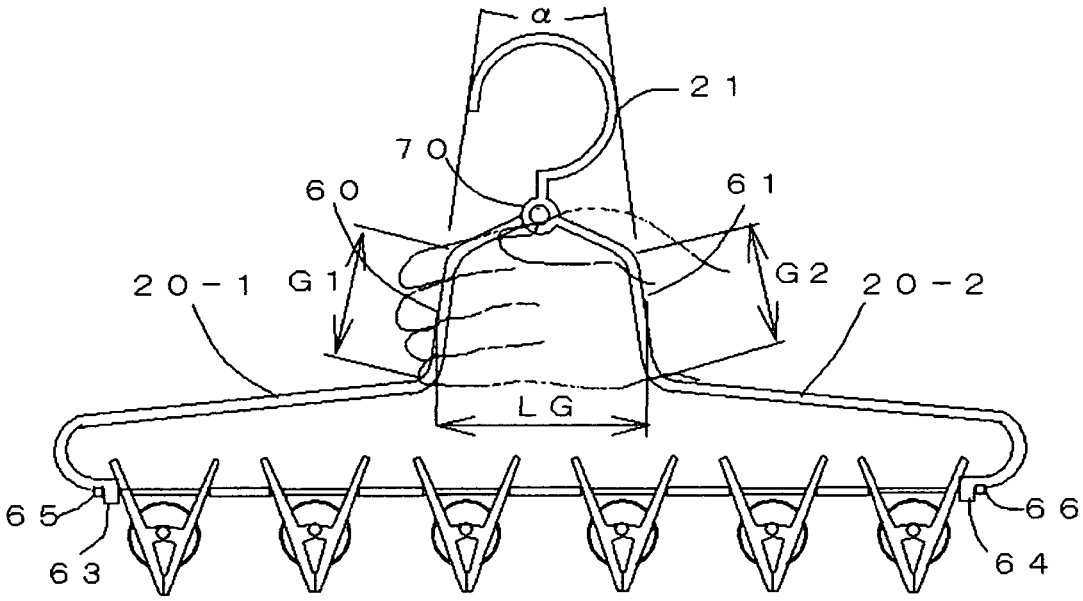
FIG. 18 is a front view of an eighth embodiment of the invention.

FIG. 18 shows the eighth embodiment which has a symmetric hanger body 20. With this clothes hanger 10 we can access from both side of the clothes hanger 10.

Figure 19:
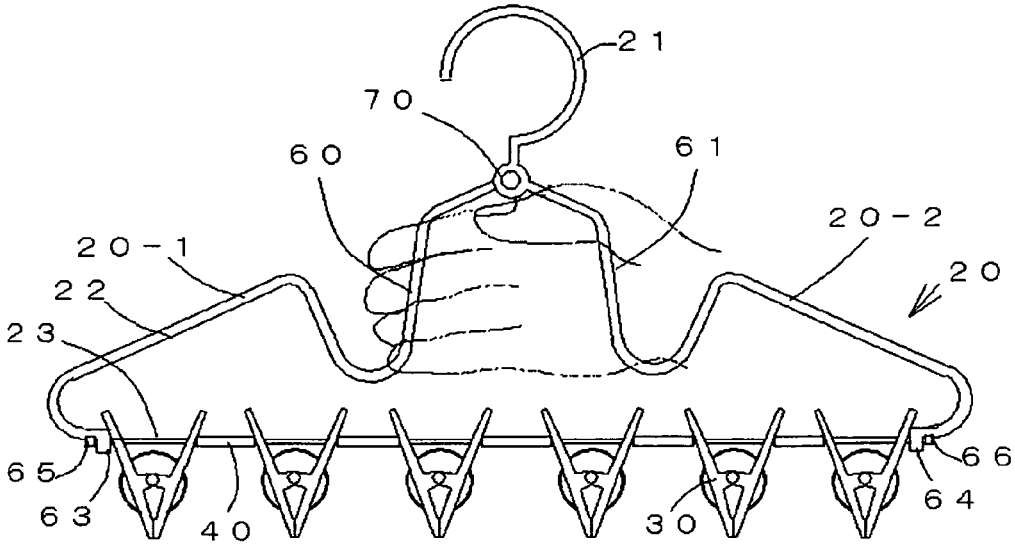
FIG. 19 is a front view of a nineth embodiment of the invention.

FIG. 19 shows the embodiment of the clothes hanger 10 with raided shoulders 22.

Figure 20:
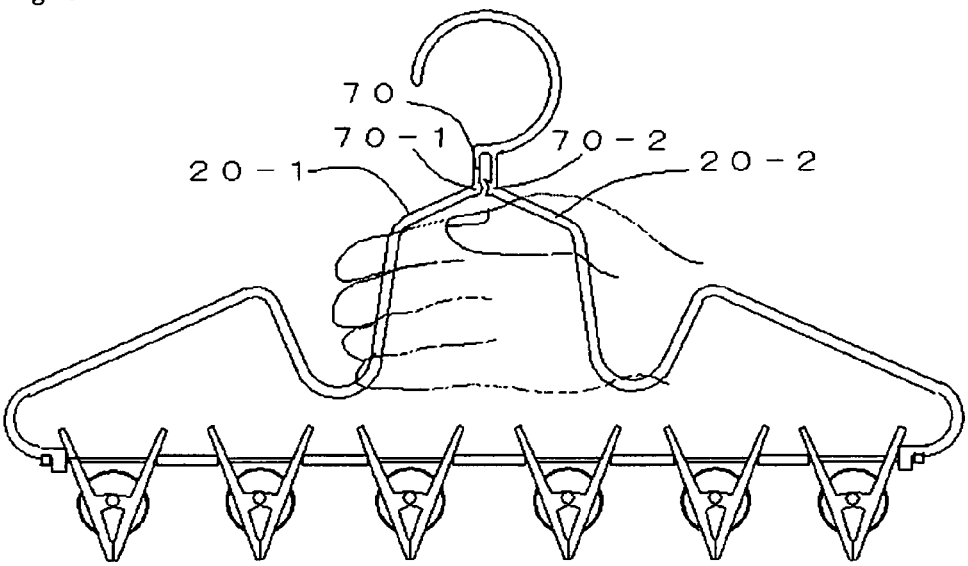
FIG. 20 is a front view of a tenth embodiment of the invention.

FIG. 20 shows the embodiment of the clothes hanger 10 which a flexible hinge 70 with thin plastic films and stopper 70-1, 70-2.

Figure 21:
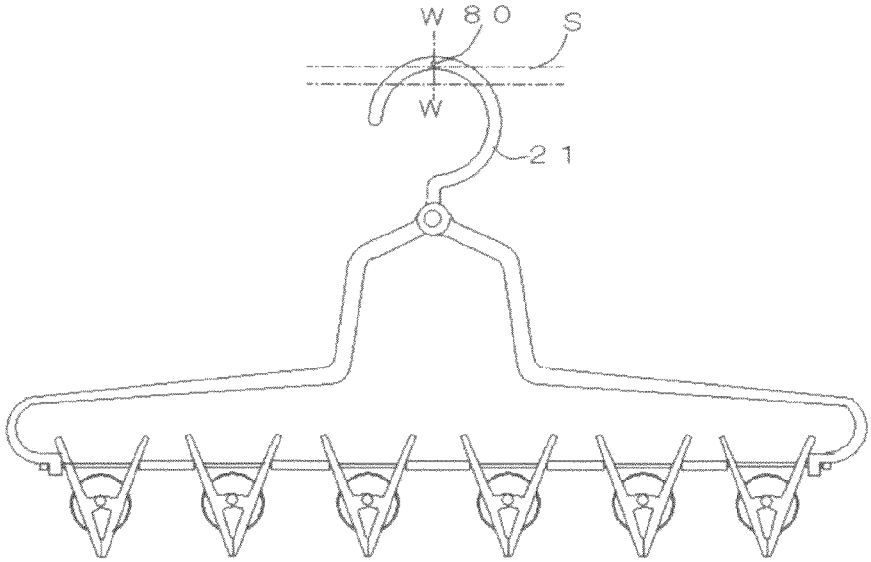
FIG. 21 is a front view of an eleventh embodiment of the invention with a lateral projection.

FIG. 21 shows the embodiment of the clothes hanger 10 which has a lateral projection 80 at near the hook 21. With this lateral projection 80, the clothes hanger 10 can be hung on the crosspiece S.

Figure 22:
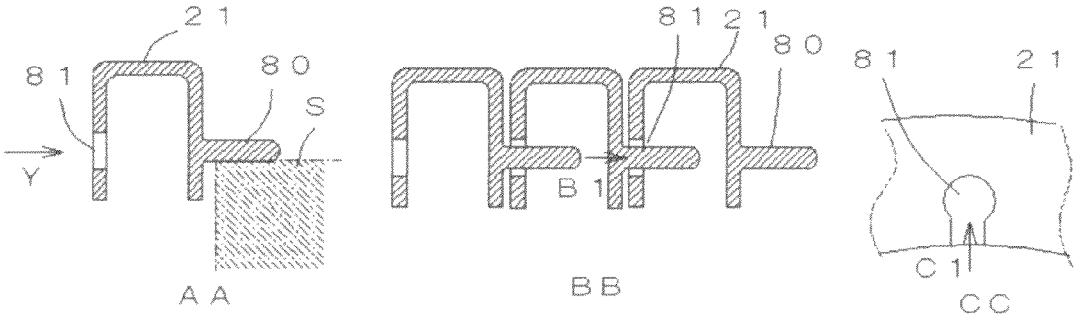
FIG. 22 is a WW cross section view of the FIG. 21.

FIG. 22 shows the cross section WW of FIG. 21. The lateral projection 80 can be inserted into a lateral projection containing space 81.

Figure 23:
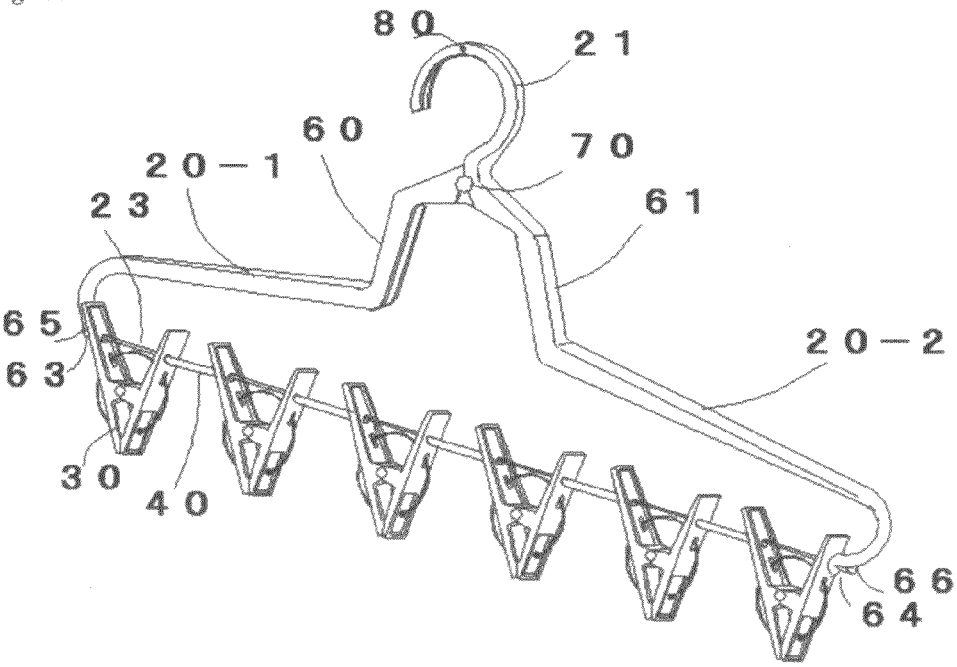
FIG. 23 is a perspective view of a 12th embodiment of the invention with a larger rigidity.

FIG. 23 shows the embodiment of the clothes hanger 10 which has a higher rigidity of the hanger body 20. The rigidity of hanger body 20 near the center is higher than the outer thereof. The hanger body 20 has U type cross section to increase strength.

Figure 24:
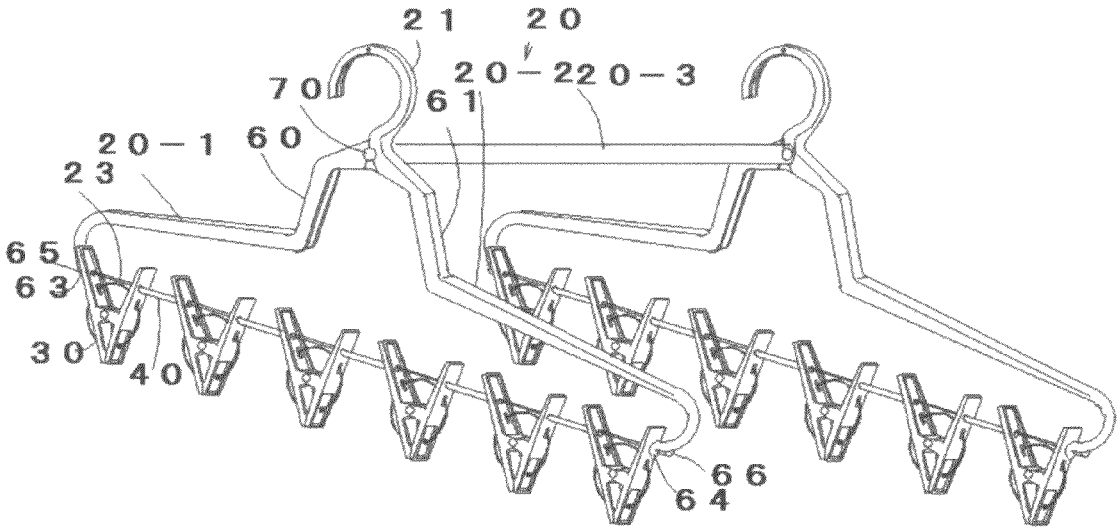
FIG. 24 is a perspective view of the 13th embodiment of the invention with two clothes hangers connected together.

FIG. 24 shows the embodiment of the two clothes hangers 10 connected together by a no. 3 hanger body 20-3.

INDUSTRIAL APPLICABILITY

This invention is available for not only hanging clothes but also some other goods.

REFERENCE SIGNS LIST

10 is a clothes hanger.
20 is a hanger body.
20-1 is a no. 1 hanger body.
20-2 is a no. 2 hanger body.
20-3 is a no. 3 hanger body.
21 is a hook.
22 is a shoulder.
23 is a rod.
30 is a clip.
31 is a clip body.
32 is a through hole.
33 is a hinge.
34 is a holding part.
35 is an elastic element.
36 is an operation part.
40 is a spacer.
41 is a tube.
42 is a flange;
50 is a release assisting part,
60 is a first pushing part.
61 is a second pushing part.
63 is a first clip pressing part.
64 is a second clip pressing part.
65, 66 are retainers.
70 is a hinge.
80 is a lateral projection.
81 is a lateral projection containing space.

The invention claimed is:

1. A clothes hanger comprising;
a substantially horizontally arranged rod;
a hanger body which supports said rod at the both ends thereof;
a plural clip through which said rod is inserted;
and a plural spacer through which said rod is inserted between said clips;
wherein said each clip has a pair of clip bodies, a hinge situated near the center of said clip bodies, a through hole and an operation part formed above said hinge, a holding part at the lower end of said clip bodies and an elastic element which forces said holding part to the closed position; wherein said hanger body is comprised of a no. 1 hanger body and a no. 2 hanger body, a moving element between said no. 1 hanger body and no. 2 hanger body, a no. 1 clip pressing part and a no. 2 clip pressing part provided at each outer end of no. 1 hanger body and no. 2 hanger body, and a no. 1 pushing part and a no. 2 pushing part situated between said each clip pressing part and said moving element,
wherein said rod is slidably inserted into said no. 1 clip pressing part and no. 2 clip pressing part.

2. The clothes hanger of claim 1, wherein said hanger body has a lateral projection near upper middle thereof.

3. A method of hanging and releasing clothes or laundry, using a clothes hanger comprising;
a substantially horizontally arranged rod;
a rigid hanger body which support said rod at the both ends thereof;
a plural clip through which said rod is inserted;
and a plural spacer through which said rod is inserted between said clips;
wherein said each clip has a pair of clip bodies, a hinge situated near the center of said clip bodies, a through hole and an operation part formed above said hinge, a holding part at the lower end of said clip bodies; and an elastic element which forces said holding part to the closed position;

wherein said hanger body is comprised of a no. 1 hanger body and a no. 2 hanger body, a moving element between said no. 1 hanger body and no. 2 hanger body, a no. 1 clip pressing part and a no. 2 clip pressing part provided at each outer end of said no. 1 hanger body and no. 2 hanger body, and a no. 1 pushing part and a no. 2 pushing part situated between said each clip pressing part and said moving element, wherein said rod is slidably inserted into said no. 1 clip pressing part and no. 2 clip pressing part, when holding the clothes, said operation parts are pressed inwardly, when all clothes and laundries are released at once, said no. 1 pushing part and no. 2 pushing part are grasped by a hand.

* * * * *